US008579175B2

(12) United States Patent
Mina

(10) Patent No.: US 8,579,175 B2
(45) Date of Patent: Nov. 12, 2013

(54) VALVE CAP FOR PNEUMATIC NAILER

(75) Inventor: Nathan Mina, Lake in the Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 316 days.

(21) Appl. No.: 13/037,872

(22) Filed: Mar. 1, 2011

(65) Prior Publication Data

US 2012/0223120 A1 Sep. 6, 2012

(51) Int. Cl.
*B25C 1/04* (2006.01)

(52) U.S. Cl.
USPC ..... 227/130

(58) Field of Classification Search
USPC ..... 227/130
See application file for complete search history.

(56) References Cited

U.S. PATENT DOCUMENTS 3,638,532 A 2/1972 Novak
3,730,414 A * 5/1973 Becht ..... 227/130
3,837,556 A * 9/1974 Doyle et al. ..... 227/136
3,850,079 A * 11/1974 Fehrs ..... 91/308
3,888,404 A * 6/1975 Ramspeck et al. ..... 227/8
3,905,535 A * 9/1975 Novak et al. ..... 227/120
4,165,676 A * 8/1979 Siegmann ..... 91/461
4,401,251 A * 8/1983 Nikolich ..... 227/130
4,403,722 A * 9/1983 Nikolich ..... 227/8
5,829,660 A * 11/1998 White ..... 227/8
7,137,186 B2 * 11/2006 Wojcicki et al. ..... 29/592
2007/0075113 A1 * 4/2007 Tillinghast et al. ..... 227/130

* cited by examiner

*Primary Examiner* — Brian D Nash
(74) *Attorney, Agent, or Firm* — Greer, Burns & Crain, Ltd.; Patty Chidiac; Mark W. Croll

(57) ABSTRACT

A pneumatic nailer includes a tool housing enclosing a cylinder with a reciprocating drive piston, and having a trigger and a workpiece contact element both connected to a trigger valve. A valve cap is mounted to the housing and includes a cycle valve and a dump valve, each valve reciprocating in a respective valve chamber. The dump valve controls drive pressure for the drive piston, the cycle valve controls the return of the dump valve to allow piston return. The valve cap and the valves are constructed and arranged such that the piston is returned to a start position independent of positions of the trigger or the workpiece contact element.

20 Claims, 11 Drawing Sheets

VALVE CAP FOR PNEUMATIC NAILER

BACKGROUND

The present invention relates to fastener driving tools, and more particularly to pneumatically powered fastener drivers, also referred to as pneumatic nailers.

In conventional pneumatic nailers, such as those disclosed in U.S. Pat. No. 3,638,532 incorporated by reference, the nailer is pressed down upon a workpiece needing a fastener, and in so doing, a workpiece contact element (WCE) is retracted relative to the tool housing. User depression of a trigger activates a trigger valve, which directs pneumatic pressure within the tool such that a piston is driven down a cylinder to impact and drive a fastener into the workpiece. When the trigger and the WCE are activated, there is always a leak path through the trigger valve, which keeps the main valve open and the piston/driver blade assembly biased downward. The '532 patent discloses the use of a multi-valve housing located near the tool trigger where continued depression of the trigger results in a single cycle or an automatic repetitive cycling of the drive piston. In practice, this construction has proved too expensive to be commercially successful.

In the course of driving the piston down the cylinder, the pneumatic pressure is diverted to a return chamber within the tool housing. Once the fastener is driven, the user typically releases the trigger, and/or lifts the tool from the workpiece, which allows the WCE to return to its start position. When either of these conditions occurs, the trigger valve closes and pressure in the return chamber pushes the piston back to the start position. As the trigger is released, the main system pressure closes the main valve on top of the cylinder to prepare for the next cycle. As the piston moves upwardly, the air on top of the piston is vented through the exhaust port in the center of the main valve. However, if the user does not release the trigger and the WCE remains depressed, the piston will not return to the start position. Piston return is activated by either the release of the trigger or of the WCE.

With conventional pneumatic nailers, if the user drives fasteners at too rapid a rate, for example when building cabinets and fastening an elongate strip forming a seam, the driver blade can scratch the workpiece as the tool is dragged along the seam being fastened. Such damage occurs as the user drags the tool from one workpiece location to the next. This is because the piston has not returned to the start position. Thus, conventional pneumatic nailers suffer from the potential for the piston to fail to sufficiently rapidly return to the start position.

SUMMARY

The above-identified drawbacks of conventional pneumatic nailers are addressed by providing a pneumatic nailer valve cap which is configured to receive a supply of pressurized air from a return chamber that controls the appropriate cycle and dump valves such that while the piston is still at the lower end of the cylinder after driving a fastener, the tool main valve is closed, enabling the piston to be returned to the start position regardless of the position of the trigger or WCE. Accordingly, more rapid tool cycling is achieved than is available with conventional pneumatic nailers.

The present valve cap is preferably mounted to the tool housing at an upper end of the housing, above the cylinder. Configured for enclosing both the dump and cycle valves, the valve cap is closely associated with the tool main valve for more efficient operation. A conduit such as a flexible hose directs a portion of pressurized air from the tool return chamber to the valve cap. This portion of pressurized air is used for shuttling the cycle valve once the piston has completed its driving movement and is at the lower end of the cylinder. The diverted portion of pressurized air in turn moves the dump valve, closing the main valve to enable the piston return.

Another advantage of the present valve cap is its modular construction, which facilitates the retrofitting of conventional pneumatic tools to provide the enhanced piston return capabilities of the present tool. Such a retrofit kit includes a cover plate, the present valve cap and the conduit, among other things, such as a spacer, a modified cylinder, the conduit and seals or gaskets as needed.

More specifically, a pneumatic nailer includes a tool housing enclosing a cylinder with a reciprocating drive piston, and having a trigger and a workpiece contact element both connected to a trigger valve. A valve cap is mounted to the housing and includes a cycle valve and a dump valve, each valve reciprocating in a respective valve chamber. The dump valve controls drive pressure for the drive piston, the cycle valve controls the return of the dump valve to allow piston return. The valve cap and the valves are constructed and arranged such that the piston is returned to a start position independent of positions of the trigger or the workpiece contact element.

In another embodiment, a valve cap assembly is provided for installation on a pneumatic nailer having a housing enclosing a cylinder, defining a return chamber and having an upper end opposite a workpiece contact element end. Included in the assembly is a valve cap enclosing a dump valve and a cycle valve, each valve having a shuttle being disposed for reciprocation in a respective chamber in the cap. A conduit connects the return chamber to the cycle valve for operating a main valve for facilitating piston return to a start position independent of a position of a trigger valve.

DETAILED DESCRIPTION

Figure 1:
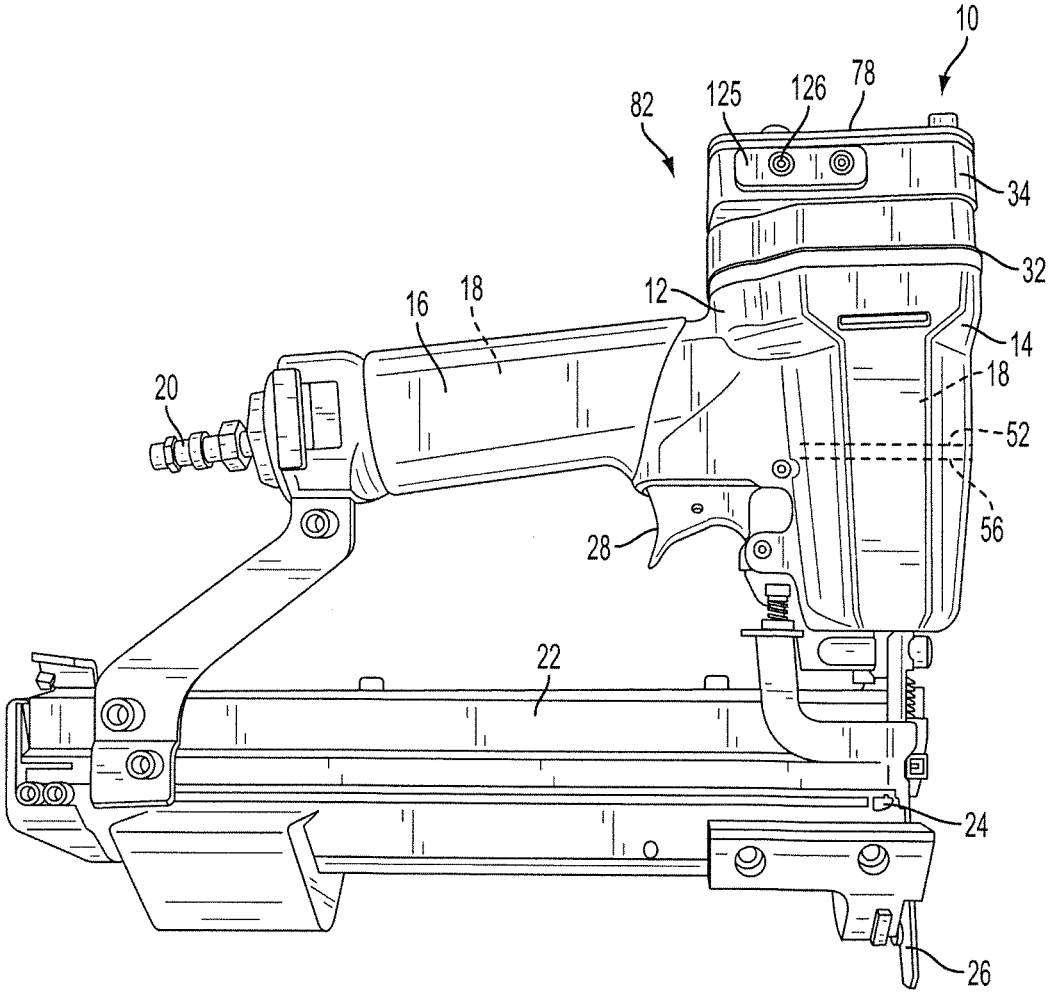
FIG. 1 is a side view of a pneumatic nailer equipped with the present valve cap.
Figure 4:
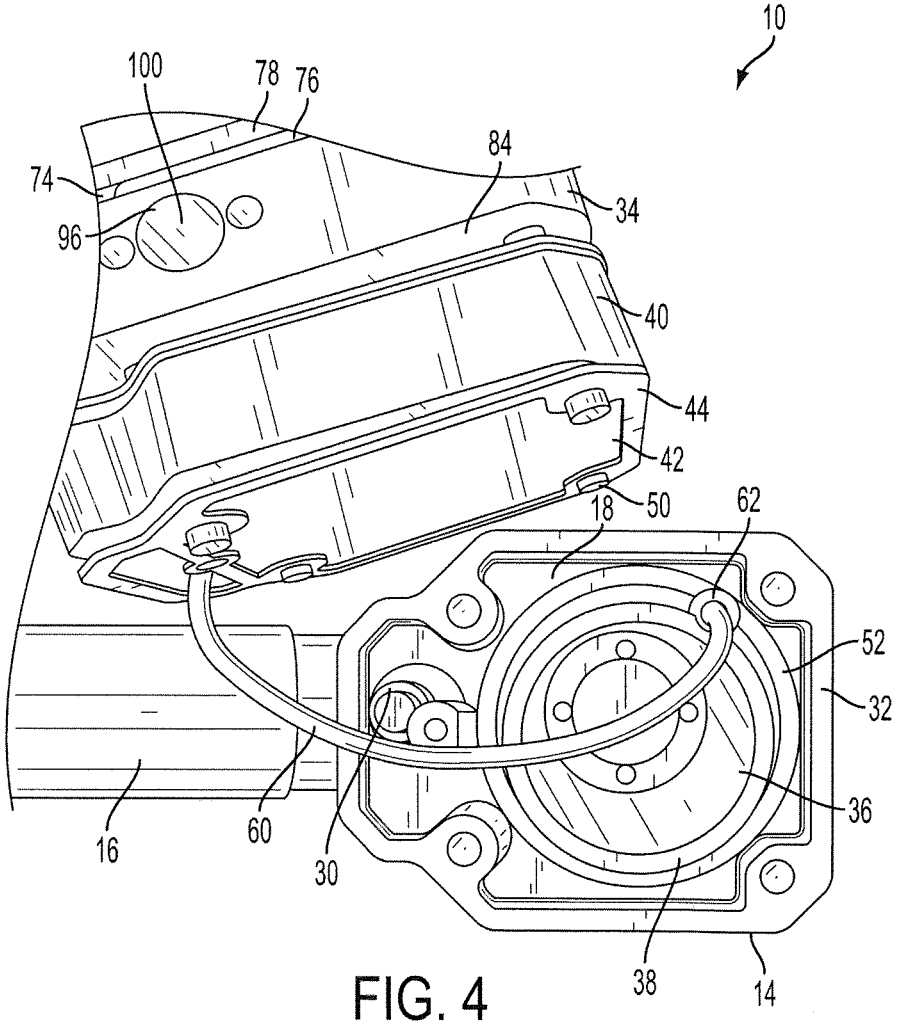
FIG. 4 is an exploded top view of the tool of FIG. 1.

Referring to FIG. 1, a fastener driving tool, generally designated 10, includes a housing 12 having a generally vertically extending portion 14 and a rearwardly extending handle portion 16 defining and enclosing a fluid reservoir 18 (FIG. 4). A pneumatic air connection nipple 20 projects rearwardly from the handle portion 16. A pressurized line from a compressor (not shown) as is known in the art pressurizes the fluid reservoir 18. Also as is known in the art, a magazine 22 feeds fasteners to a tool nose 24 having a workpiece contact element (WCE) 26, the latter vertically reciprocally slidable relative to the nose so that it retracts upon the use pressing the tool 10 against a workpiece prior to driving a fastener. A trigger 28 controls a trigger valve 30 (FIG. 4) located within the housing 12. As is the case with conventional pneumatic nailers, in the tool 10 the WCE 26 is mechanically linked to the trigger valve 30, so that the trigger valve is actuable by movement of both the trigger 28 and the WCE 26 concurrently.

Figure 2:
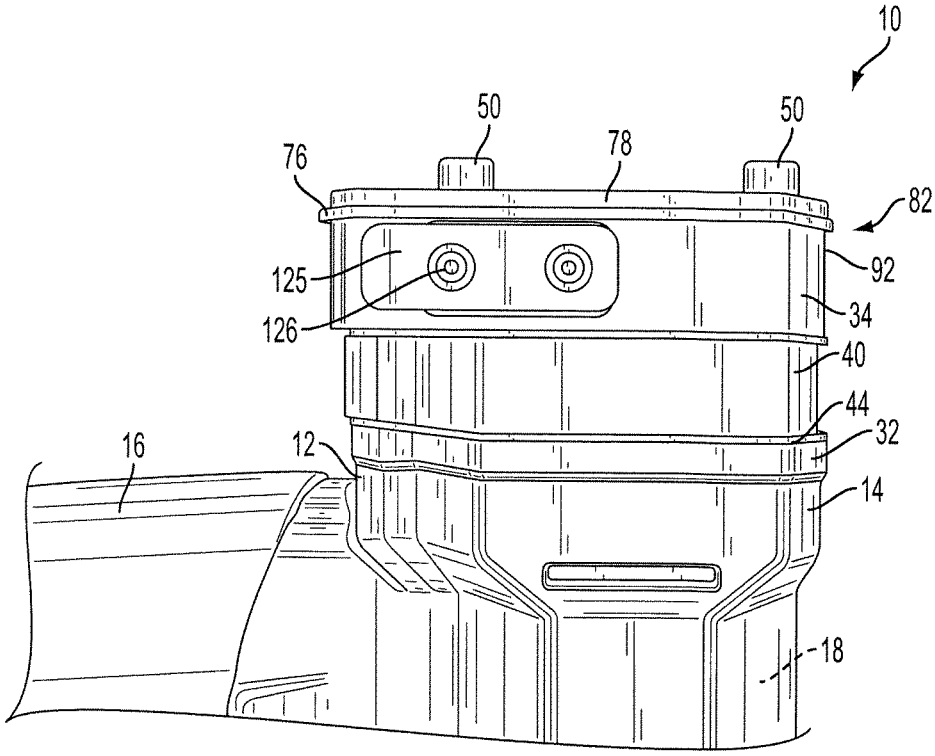
FIG. 2 is a fragmentary, enlarged side view of the tool of FIG. 1 showing the valve cap.
Figure 3:
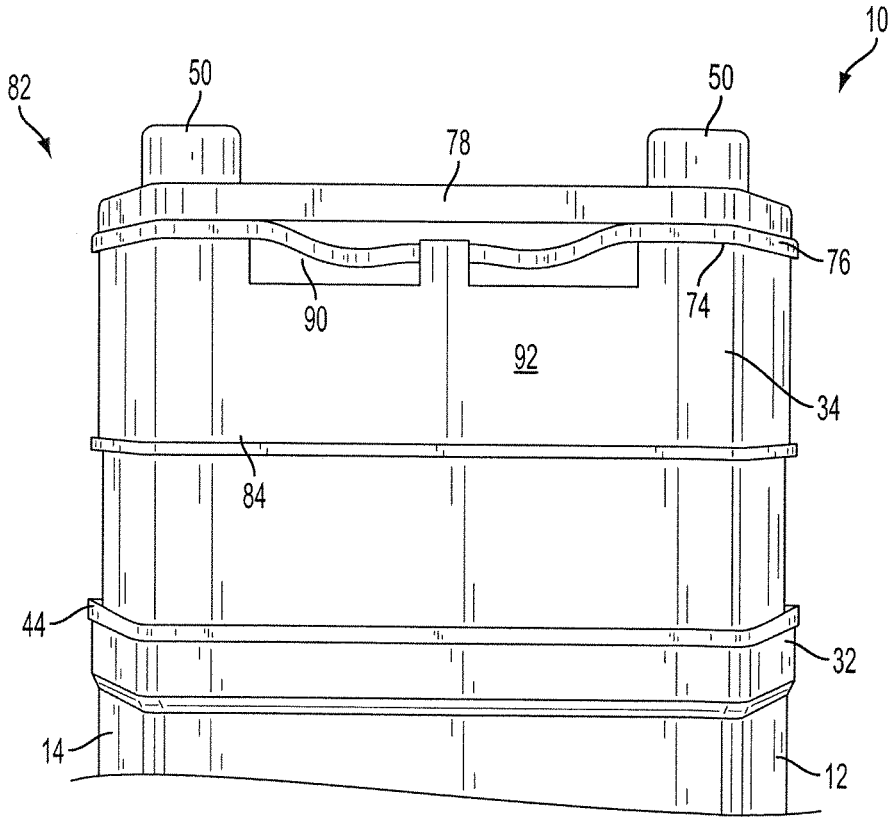
FIG. 3 is a fragmentary enlarged front view of the tool of FIG. 2 showing the valve cap.

Referring now to FIGS. 1-5, an important feature of the present invention is that at an upper end 32 of the vertical housing portion 14 receives a valve cap, generally designated 34. A cylinder 36 is disposed within the housing portion 14 and is dimensioned such that an upper end 38 projects above the upper housing end 32. Accordingly, a spacer 40 separates the valve cap 34 from the upper housing end 32 and defines a space 42 for accommodating the cylinder upper end 38. Thus, the valve cap 34 is mounted to the housing 12 above the cylinder 36. A suitable gasket or seal 44 pneumatically seals the spacer 40 to the housing end 32. As is known in the art, a combination piston 46 and depending driver blade 48 reciprocate within the cylinder 36 under pneumatic pressure, and the driver blade impacts fasteners provided to the tool nose 24 and drives them into a workpiece. As seen in FIGS. 2 and 3, the valve cap 34 and the spacer 40 are secured to the housing portion 14 by at least one and preferably a plurality of fasteners 50. The position and type of fastener 50 may vary to suit the application, however it is preferred that the fasteners are compatible with standard or conventional nailers so that the valve cap 34 can be retrofit onto conventional tools by replacing the existing cap (not shown).

As discussed above, a problem of conventional pneumatic nailers is that when the user is driving fasteners at a relatively fast rate, there is a tendency for the piston 46 to fail to return to a start position at or near the upper cylinder end 38. This typically occurs when the user does not release the trigger 28 sufficiently quickly between fastener driving cycles. In conventional nailers, unless the trigger valve 30 is closed, the piston 46 will not return to the start position. An important feature of the present tool 10 is that the valve cap 34 is configured such that the tool valves are manipulated to return the piston 46 to the start position independent of the position of the trigger 28 or the WCE 26. By adding the present cap with two shuttles, the driver blade/piston can return independently of operation of the trigger or the WCE.

Figure 5:
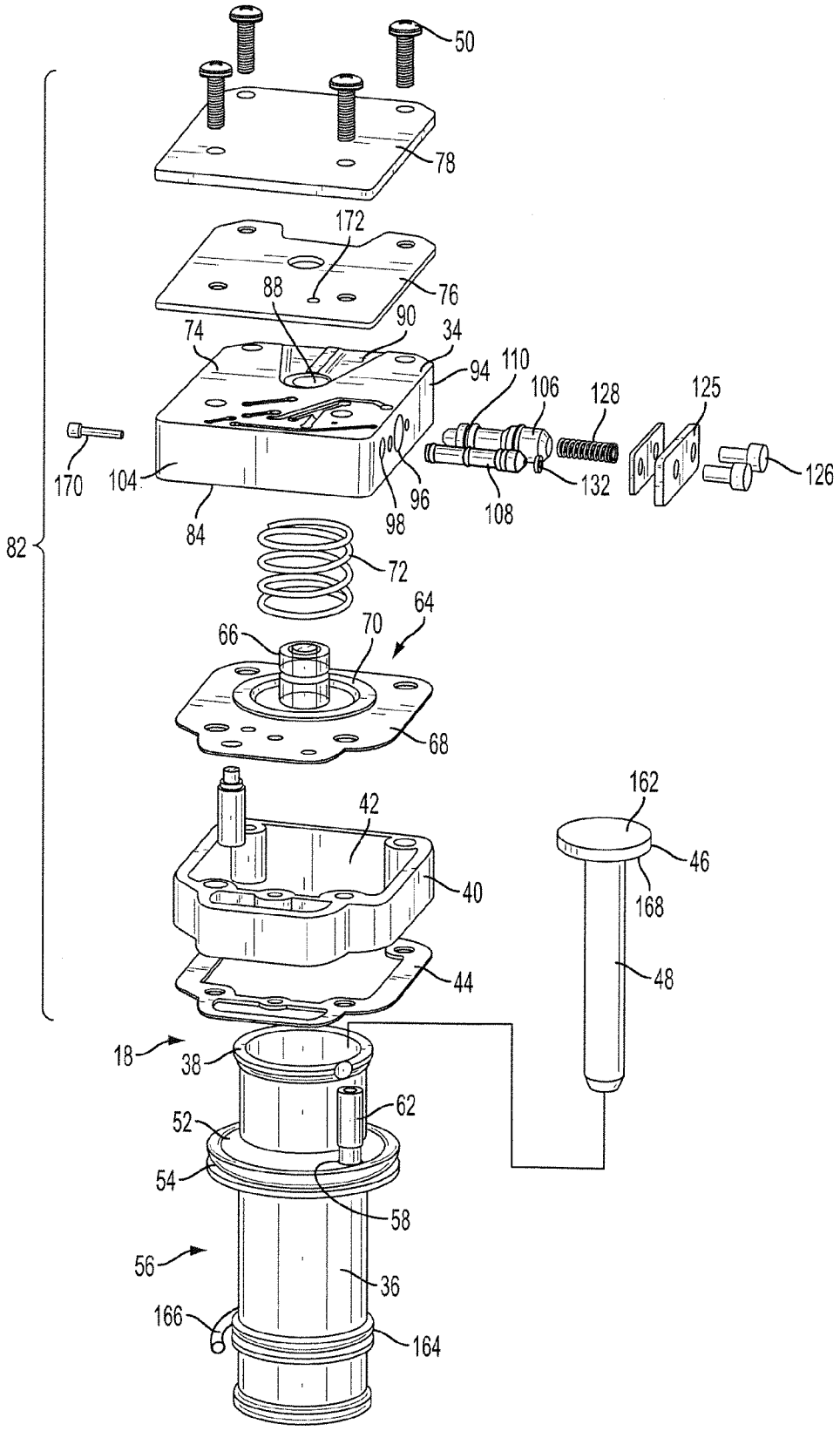
FIG. 5 is an exploded perspective view of the present valve cap assembly.

Referring now to FIGS. 4 and 5, the cylinder 36 has a radially extending flange-like bulkhead 52 with an O-ring groove 54 for accommodating an O-ring (not shown) that sealingly engages interior walls of the housing 12 and defines a sealed return chamber 56 below the bulkhead, which is sealed from the pressurized reservoir 18, located above the bulkhead (shown hidden in FIG. 1). As is well known in the art of pneumatic tools, the reservoir 18 is pressurized by compressed air entering through the nipple connector 20. An opening 58 in the bulkhead 52 sealingly accommodates a conduit 60 (FIG. 4) which connects the return chamber 56 with the valve cap 34. To facilitate the sealing engagement in the bulkhead 52, the conduit 60 is preferably provided with a resilient fitting 62. While the preferred conduit 60 is a hose, it is anticipated that other types of conduits, including relatively rigid pipes and cast passageways may be suitable for creating fluid communication between the return chamber 56 and the valve cap 34. It should be noted that in connecting to the valve cap 34, the conduit 60 passes through the space 42 defined by the spacer 40.

Between the valve cap 34 and the spacer 40 is disposed a main valve 64, which includes an axially projecting exhaust stem portion 66 and a flexible diaphragm 68. A relatively rigid disk portion 70 is located between the axial portion 66 and the diaphragm 68, and is dimensioned to overlap and seal the upper end 38 of the cylinder 36. A coil-type main valve spring 72 biases the main valve 64 in a sealing relationship with the cylinder 36. It is contemplated that other types of springs or biasing devices known in the art may be substituted for the coil type spring 72. In a rest position of the tool 10, the rigid disk portion 70 is sealed against the upper end 38 of the cylinder 36 due to the action of the main valve spring 72, and the pneumatic pressure exerted upon the main valve 64 due to its location in fluid communication with the reservoir 18.

An upper surface 74 of the valve cap 34 is sealingly covered by a valve cap gasket 76, which in turn is covered by a top cap 78. The top cap 78 is secured to the upper end of the housing 32 using the fasteners 50 such as threaded screws or the like passing through the valve cap gasket 76, the valve cap 34, the main valve 64, the spacer 40 and the spacer gasket 44. The above-listed components secured to the housing portion 14 by the fasteners 50 will be referred to generally as the valve cap assembly 82.

Referring now to FIGS. 5-11, the construction and operation of the valve cap 34 will be described in greater detail. The valve cap 34 is a block of rigid material such as aluminum, steel or the like which is castable and machinable. Opposite the upper surface 74, a lower surface 84 includes a cylindrical, larger diameter undercut 86 (shown hidden) dimensioned to provide a seat for the disk portion 70, and an inner, smaller diameter undercut 87 dimensioned for providing a seat for the main valve spring 72 and for accommodating the vertically reciprocating portion 66 of the main valve 64. It will be seen that the main valve 64 and the main valve spring 72 are located between the valve cap 34 and the spacer 40.

A main valve exhaust port 88 is in fluid communication with the reservoir 18 depending on the position of the vertically reciprocating portion 66. At least one exhaust opening 90 opening at a front side 92 of the valve cap 34 is in communication with the main valve exhaust port 88. The exhaust opening 90, as well as other passageways cut into the upper surface 74, are sealed by the valve cap gasket 76 upon assembly of the valve assembly 82 to the tool 10. A first side 94 of the valve cap 34 extends generally normally from the front side 92 and includes respective outlets 96 and 98 of a dump valve chamber 100 and a cycle valve chamber 102, each extending into a body 104 of the valve cap 34. While the orientation and dimensions of the chambers 100 and 102 may vary to suit the application, the chambers are preferably in spaced, generally parallel relationship to each other and extend axially in parallel with the front side 92 of the valve cap 34. Also, the dump valve chamber 100 preferably has a larger diameter than the cycle valve chamber 102.

In each of the chambers 100 and 102 is respectively disposed a dump valve shuttle 106 and a cycle valve shuttle 108 (FIG. 5). The shuttles 106 and 108 are made of rigid, durable materials such as metal, engineered plastic or the like.

To simplify the present explanation, the dump valve, which includes the dump valve shuttle 106 and the dump valve chamber 100, will be designated by the shuttle number 106, and the cycle valve, including the cycle valve shuttle 108 and the cycle valve chamber 102, will be designated by the cycle shuttle number 108. The dump valve 106 controls drive pressure for the drive piston 46, and the cycle valve controls return of the dump valve, which allows piston return to the start position at the upper end 38 of the cylinder 36 for beginning the next fastener driving cycle. As will be described in greater detail below, an important function of the valve cap 34 is that it is constructed and arranged such that the piston 46 is returned to the start position independent of positions of the trigger 28 or the WCE 26.

Each shuttle 106 and 108 is divided by annular seals 110 such as O-rings into functional portions associated respectively with first, second and third dump subchambers 112, 114, 116 of the dump valve chamber 100, and first, second, third and fourth cycle subchambers 118, 120, 122, 124 of the cycle subchamber 102. A cover plate 125 and associated fasteners 126 retain the shuttles 106, 108 in the respective chambers 100, 102.

Figure 6:
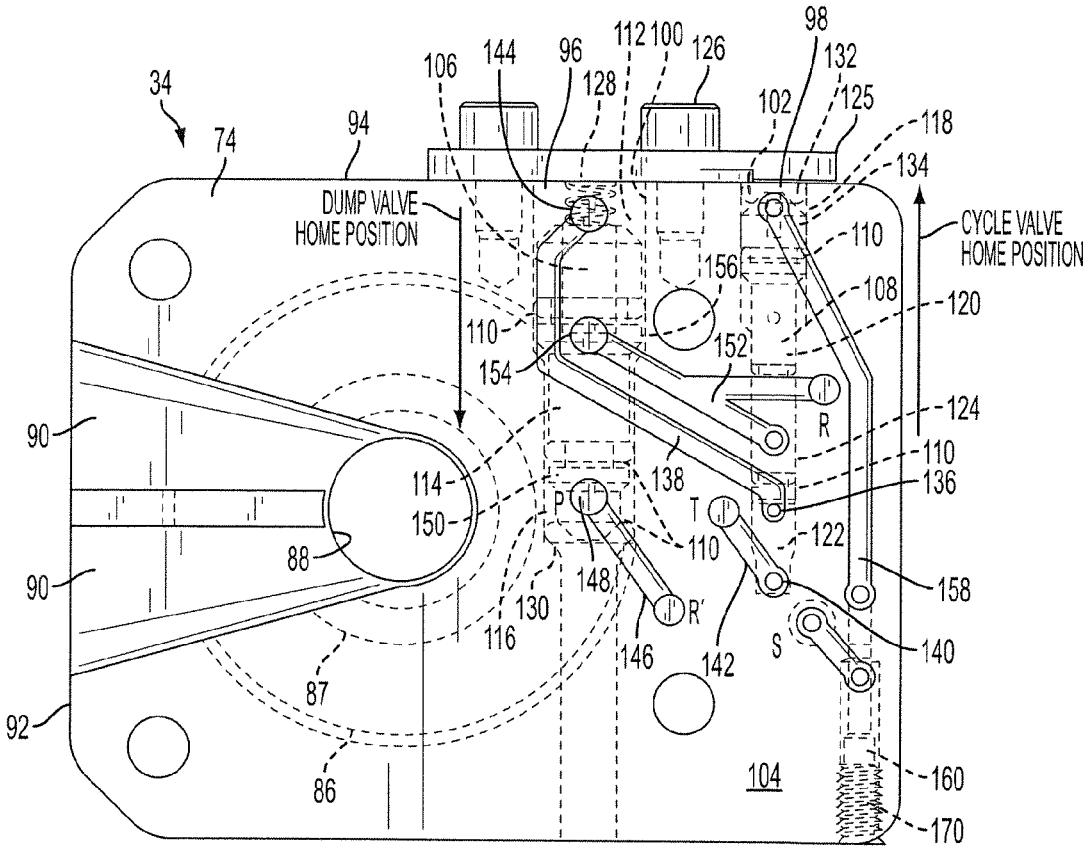
FIG. 6 is an overhead plan view of the present valve cap, with the trigger valve closed.

Referring now to FIGS. 5 and 6, in a tool rest position, it will be seen that the dump valve shuttle 106 is biased to a home or closed position by a biasing element or dump valve spring 128 held in place by the cover plate 125 so that in the closed position, the dump valve shuttle is seated at an opposite end 130 of the dump valve chamber 100 from the outlet 96. On the contrary, the cycle valve shuttle 108 is not spring biased, but reciprocates within the cycle chamber 102 solely through pneumatic pressure. In the rest position shown in FIG. 6, the cycle valve shuttle 108 is pneumatically biased towards, and seated against the outlet 98 in a sealing relationship created between an O-ring 132 sealingly accommodating a conical end 134 of the cycle valve shuttle 108. The cycle shuttle 108 is biased as shown in the rest position via system pressure, which also helps to bias the dump valve 106 through an opening 136 which connects to a passageway 138. The cycle shuttle 108 is biased by pressure entering and pressurizing the third cycle subchamber 122 from the reservoir 18 through a relatively small opening T connected to the cycle subchamber through an opening 140 leading to a passageway 142. In this position, the conical end 134 of the cycle valve shuttle 108 is exposed to atmospheric pressure as will be described below.

Referring again to FIGS. 5 and 6, when the tool 10 is in the depicted rest position, system pressure assists the main valve spring 72 in forcing the main valve 64 downward against the upper end 38 of the cylinder 36, sealing it. The dump valve shuttle 106 controls the main valve 64. When the main valve 64 is closed, pressurized airflow is prevented from flowing to the upper surface of the piston 46. This prevents tool firing upon initial tool pressurization.

As seen in FIG. 6, the dump valve shuttle is 106 biased to the closed or home position by the dump valve spring 128, as well as by system air pressure flowing into the valve cap 34 through the passageway 138, which is in communication with the first dump subchamber 112 via an opening 144. System pressure is also supplied and acts on the dump valve shuttle 106 through the opening R1, in communication with passageway 146 to opening 148 in the third dump subchamber 116. This pressure works against a radial flange 150 (FIGS. 6-8) on the dump valve shuttle, and as it flows down the opening 148, acts upon the diaphragm 68 of the main valve 64 to hold it closed.

The two supply or system flows in passageways 138 and 146 from the reservoir 18 to bias the dump valve shuttle 106 to the closed position are countered by a like system flow from opening R through a pathway 152 in the upper valve cap surface 74 which is in communication with the second dump subchamber 114 via an opening 154. This pressure is sufficient to open the dump valve shuttle 106 when needed, and acts against a radial bevel 156 of the dump valve shuttle 106, located in the second dump subchamber 114. In the rest position, the dump valve shuttle 106 is thus spring biased into the closed position, as well as being pneumatically biased toward the closed position and simultaneously to the open position. Accordingly, the dump valve spring 128 provides the extra force to urge the shuttle 106 to the closed position. Thus, in the rest position, the dump shuttle 106 is biased in an opposite direction relative to the cycle shuttle 108.

A signal passageway 158 is cut into the upper valve cap surface 74 and is connected to a signal opening S via a needle valve chamber 160 at one end, and at an opposite end, to the first cycle subchamber 118. In FIG. 6, this pathway is open to atmosphere, so that a pressurized force from the opening T is greater than atmosphere, and the cycle valve shuttle 108 is forced to the home position. The opening S is connected to the return chamber 56, which is open to atmosphere through the tool nose 24 at the bottom of the cylinder 36. As is known in the art, variable sizing of the various openings R, R1, T and S is used to control pressure forces as desired. Thus, the cycle valve 108 is constructed and arranged for receiving signal pressure through the opening S from the return chamber 56, to move the dump valve 106, which in turn closes the main valve 64 to permit return of the piston 46, as will be described in greater detail below.

Figure 7:
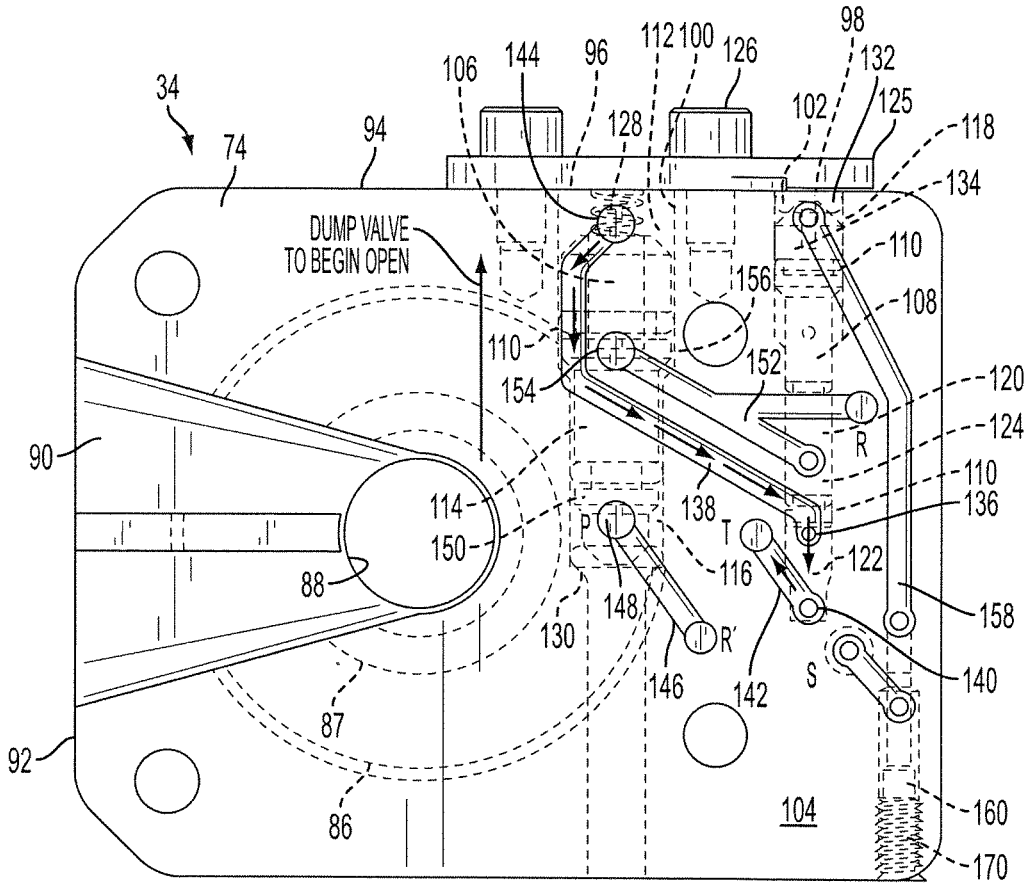
FIG. 7 is a schematic section as seen in FIG. 6 with the trigger valve open and the dump valve starting to open.

Referring now to FIG. 7, as the tool 10 is activated, the user presses the tool against a workpiece, causing retraction of the WCE 26, and begins pulling the trigger 28, which shuts off the trigger valve 30 from system pressure from the reservoir 18 in the housing 12, and simultaneously provides a leak path to release pressure from the housing 12 out to atmosphere, enabling the system pressure in R and R1 to open the dump valve shuttle 106, causing the main valve 64 to open, and momentarily separate from the upper end 38 of the cylinder 36, allowing air to flow onto a top surface 162 of the piston 46.

More specifically, in the valve cap 34, this diversion of pressure caused by depressing the WCE 26 and the pulling of the trigger 28 and opening of the trigger valve 30, creates a leak path out opening T, which then draws air from the passageway 138 from the first dump subchamber 112 to ambient, thus reducing the pneumatic bias against the dump valve shuttle 106 so that the dump valve spring 128 is the only force pushing the shuttle towards the closed position of FIG. 6. With this transfer of pneumatic pressure, and system pressure flowing through openings R and R1 and the corresponding passageways 152 and 146 the force from the system pressure which was always flowing but was countered by system pressure through the passageway 138 and the spring pressure, gradually overcomes the spring to move the dump valve shuttle 106 towards the open position, where it will be seated adjacent the cover plate 125. During the trigger pull and the driving cycle, the cycle valve 108 remains stationary, seated adjacent the outlet 98 until a pneumatic signal is received as described below.

Figure 8:
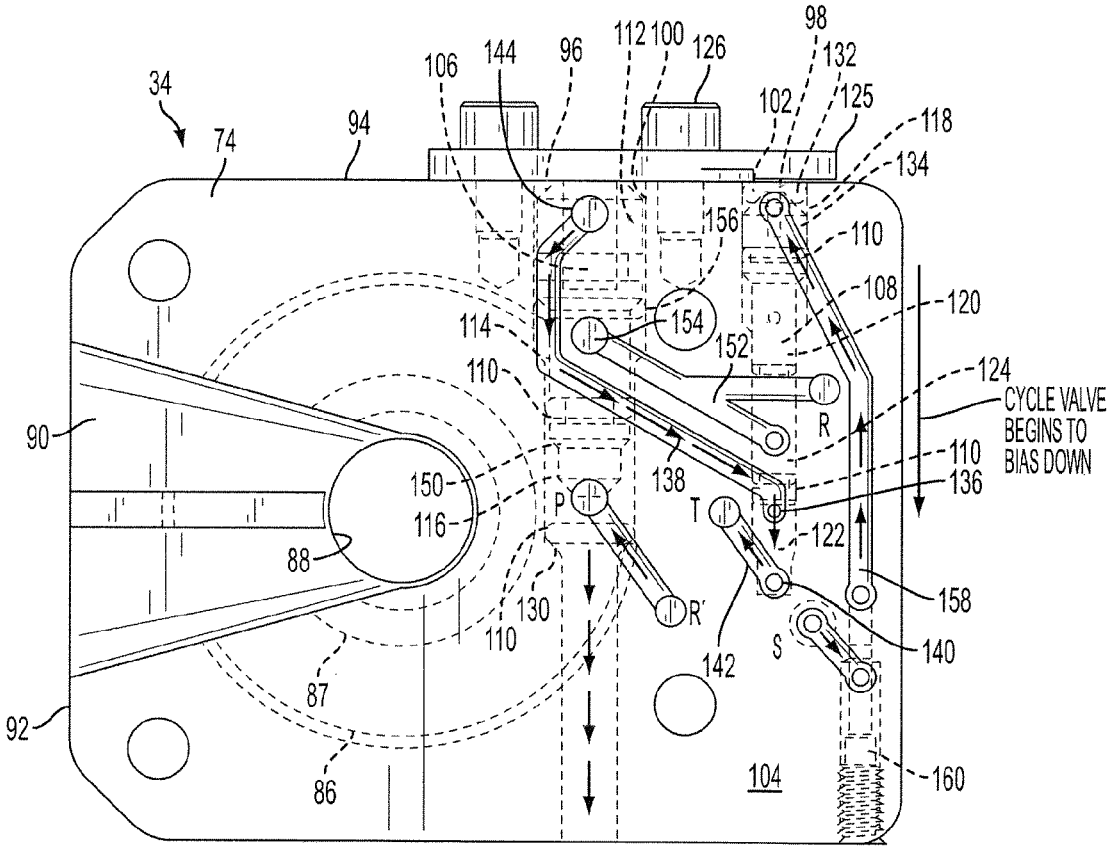
FIG. 8 is a schematic section as seen in FIG. 6 with the trigger and dump valve open and cycle valve starting to bias downward.

Referring now to FIG. 8, which depicts the operation of the valve cap 34 as a second phase of the operation described in FIG. 7 where the piston 46 is still in the start position before a fastener is driven. In FIG. 8, system pressure acting through the opening R and passing through the pathway 152 has acted on the bevel and has moved the dump shuttle 106 to the full open position, bottomed against the outlet 96 of the dump valve chamber 100. At the same time, the piston 46 and the driver blade 48 have moved down the cylinder 36 to a bottom end opposite the upper end 38, and a rush of pressurized air from the reservoir 18 pushing the upper side 162 of the piston via system pressure, is forced out holes in a check valve 164 (FIG. 5) at the bottom end of the cylinder which are enclosed by an O-ring 166. This air charges the return chamber 56, which is located within the tool housing 12 and below the bulkhead 52.

At this point, in a conventional nailer, if no action is taken, such as the closing of the trigger valve 30 by releasing the trigger 28, or lifting the tool from the workpiece, disengaging the WCE 26, the piston 46 will remain in the down position, because system pressure continues to flow past the opened main valve 64 and down the cylinder 36. Due to rapid operator use, in some cases the piston 46 does not return to the start position fast enough to be ready for the next driving cycle.

An important feature of the present valve cap assembly 82 is that the conduit 60 creates a fluid pathway between the return chamber 56 and the valve cap 34. This pathway permits operation of the cycle valve shuttle 108, which in turn closes the dump valve shuttle 106, and accordingly closes the main valve 64. Once the main valve 64 is closed, system pressure is no longer acting upon the upper surface 162 of the piston 46. Upon closing of the main valve 64, the pressure in the return chamber 56 acts on an underside 168 of the piston 46, returning it to the start position.

More specifically, in FIGS. 4 and 8, the conduit 60 connects the return chamber 56 with the opening S in the valve cap 34 for providing a pneumatic signal that pressurizes the signal passageway 158 that moves the cycle valve shuttle 108 to the opposite end of the cycle chamber 102 into the third cycle subchamber 122. Otherwise, the cycle valve shuttle 108 does not move from its start position through the pull of the trigger 28 to begin the drive cycle. As discussed below in relation to FIGS. 8 and 10, this signal flow instantaneously and momentarily causes the above-described movement of the cycle valve 108 and causes the supply pressure from the return chamber 56 to close the dump valve 106, then the main valve 64, which returns the piston 46 to the start position despite the trigger valve 30 remaining open.

Figure 9:
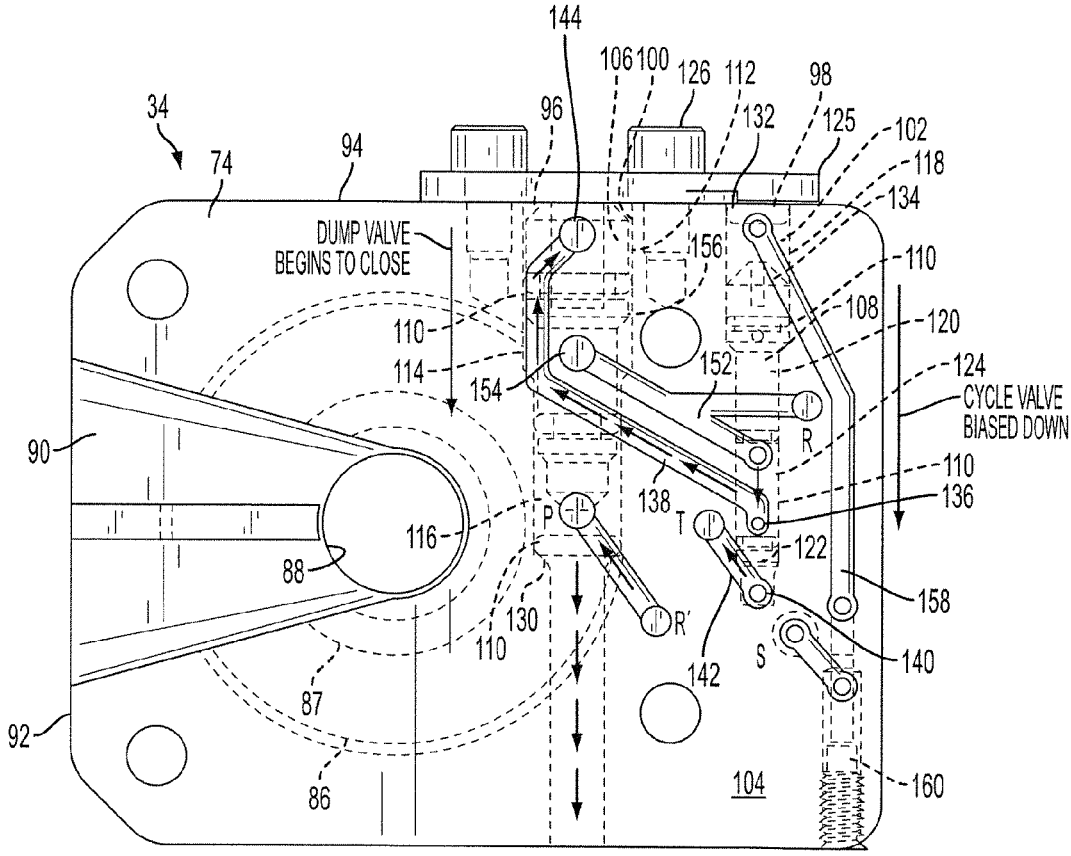
FIG. 9 is a schematic section as seen in FIG. 6 with the trigger valve open, the cycle valve biased downward, and the dump valve starting to close.

Referring now to FIG. 9, the now biased open position of the cycle valve shuttle 108 causes the system pressure to flow through the small opening 136 in the fourth cycle subchamber 124 through the passageway 138 and ultimately into the opening 144 to pressurize the dump valve shuttle 106, and coupled with the force of the dump valve spring 128, causes the dump valve to begin to close, which will eventually close the main valve 64, as pressurized flow passes from opening R1 to opening P. In FIG. 9, the trigger valve 30 is still open, because the main valve 64 is not yet closed. Thus, even though the leak path created by the opening of the trigger valve 30 is still open, the steps are in motion to close the main valve 64 and permit piston return.

Figure 10:
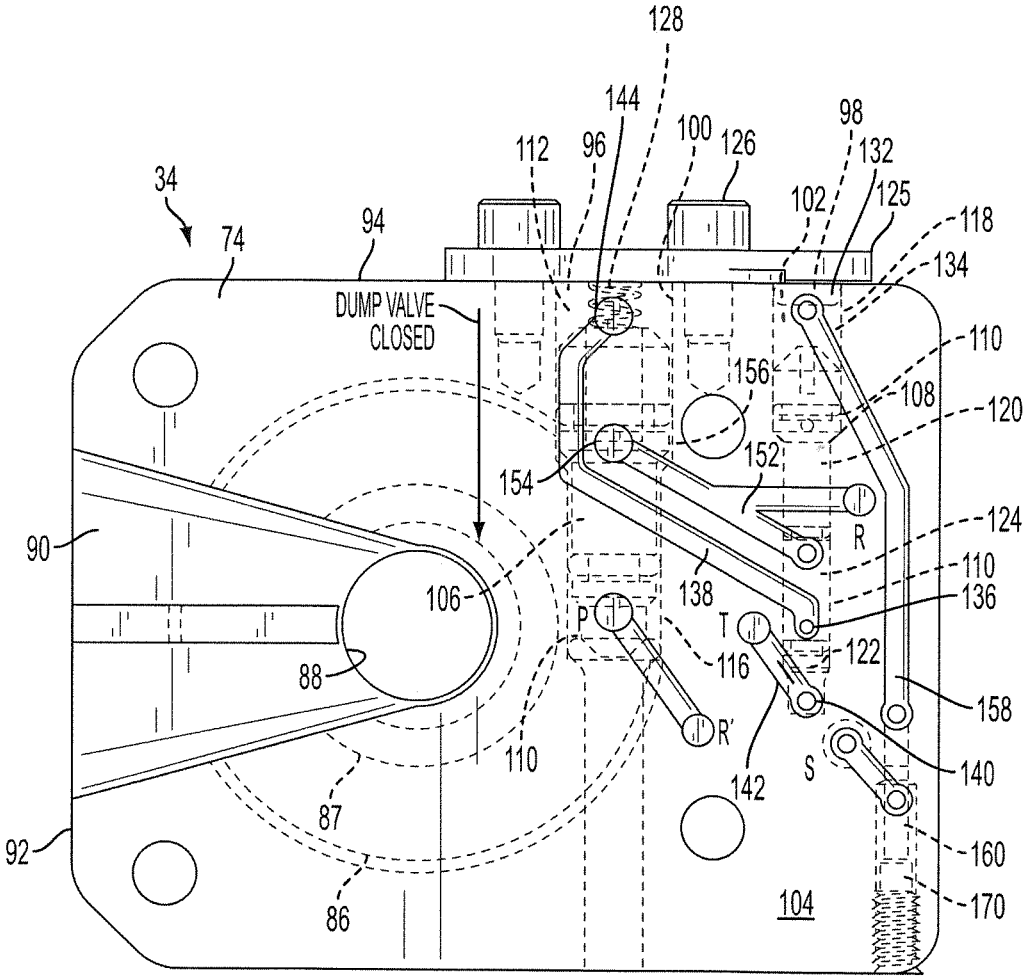
FIG. 10 is a schematic section as seen in FIG. 6 with the trigger valve open, the dump valve closed, and the cycle valve biased downward.

Referring now to FIG. 10, which depicts events occurring almost simultaneously with those described in FIG. 9, the trigger valve 30 and its corresponding leak path is still open, but the diverted system pressure caused by the shifting of the cycle valve shuttle 108 has moved the dump valve shuttle 106 to the closed position. Accordingly, the main valve 64 is also now closed, since system pressure is passing from opening R1 to opening P, sealing the upper end 38 of the cylinder 36 and allowing the pressure from the return chamber 56 to push the piston 46 back to the start position. At this time, the opening S and the signal passageway 158 are now open to atmosphere, and the cycle valve shuttle 108 is still in the open position. Air in the cylinder above the piston 46 is vented out the main valve exhaust port 88 and through the exhaust openings 90.

Figure 11:
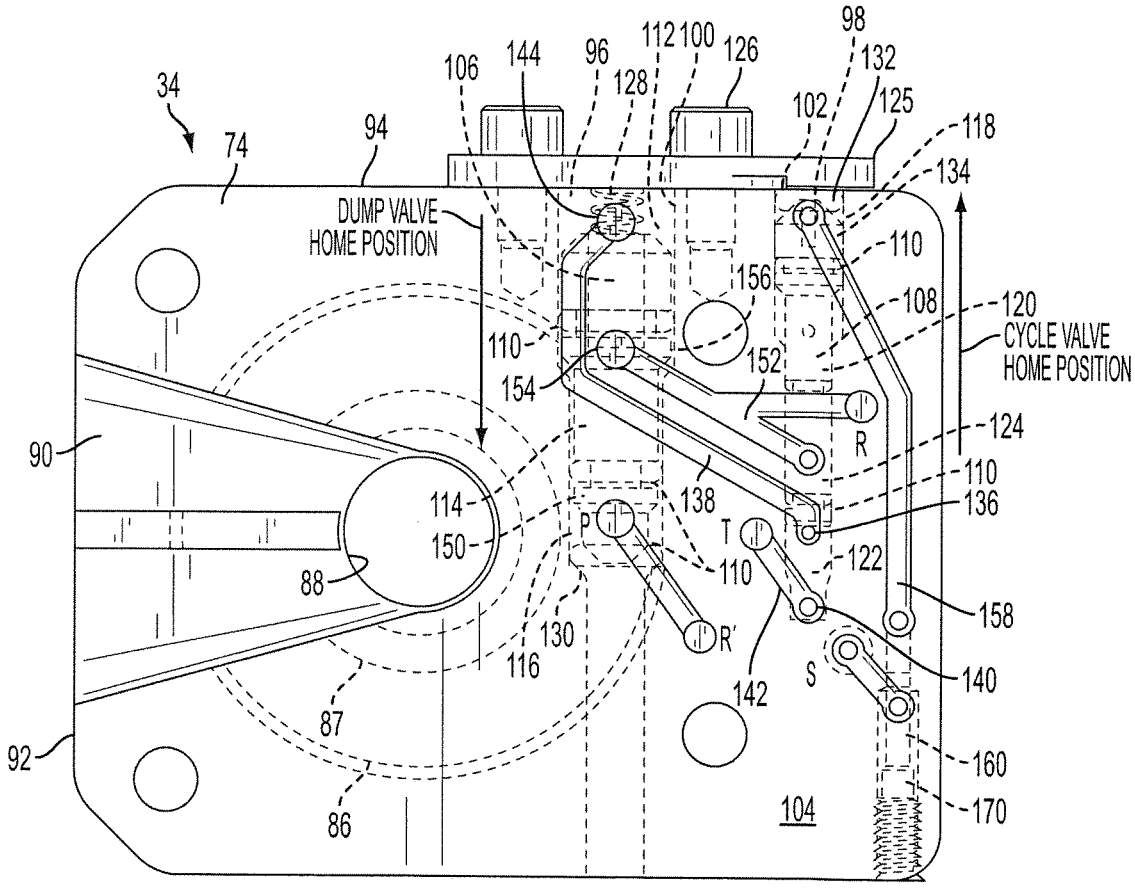
FIG. 11 is a schematic section as seen in FIG. 6 with the trigger valve closed, the dump valve closed, and the cycle valve returned to its home position.

Referring now to FIG. 11, the trigger valve 30 is now closed, which causes system pressure to flow upward in the valve cap 34 through the opening T that forces the cycle valve shuttle 108 back to the closed or home position of FIG. 5. As is known in the pneumatic tool art, the WCE 26 acts upon the trigger assembly, via an internal trip lever, where releasing either the trigger 28 or the WCE 26 will allow the trigger valve 30 to close. Thus, the trigger valve 30 is operated by either mechanism, the trigger 28 or the WCE 26, to allow the tool 10 to return to the pre-firing position. The dump valve 106 is closed, and the cycle valve shuttle 108 is seated in the home position. Now the first cycle subchamber 118 is open to atmosphere. The dump valve 106 is now in position for the beginning of the next fastener drive cycle.

It will be seen that the needle valve chamber 160 is provided with an adjustable needle valve shuttle 170 for enabling adjustment of the signal pressure through the passageway 158 to adjust the speed of operation of the cycle valve shuttle 108. This adjustment is made at the conclusion of tool assembly and is typically locked by the manufacturer to enhance performance.

Another feature of the present tool 10 is that the valve cap assembly 82 is provided with the valve cap gasket 76 having an opening 172 (FIG. 5) disposed over the second cycle subchamber 120 to create a path to atmosphere to allow breathing of the subchamber as a reaction to pressure in either subchambers 118 or 122 as described above. Thus, in this position, pressure in one of the subchambers 118, 122 will cause movement of the cycle valve shuttle, and the atmospheric path through the opening 172 allows the pressure to react against the unpressurized second subchamber 120. Also, by moving the valve cap gasket 180°, the opening 172 is plugged. Once plugged, the compressible air in the second subchamber 120 acts as a return spring to operate the cycle valve shuttle 108 independently of the trigger valve 30. Thus, the cycle valve shuttle 108 can cycle when the trigger 28 is pressed just once, thus causing automatic operation.

In addition to enhancing piston return by using the cycle valve 108 and the dump valve 106 to close the main valve 64 independently of the position of the trigger valve, the present valve cap assembly 82 can be provided in kit form for retrofitting conventional pneumatic tools to provide the above-described piston return enhancement. Such a kit preferably includes the valve cap 34 with the cycle and dump valves 108, 106, the conduit 60, the top cap 78, the valve cap gasket 76, the main valve 64, the main valve spring 72, the spacer 40 and the spacer gasket 44. In a further preferred embodiment, the kit includes a modified cylinder 36 including the opening 58 in the bulkhead 52, and the bulkhead fitting 62. It will be understood that the contents of the kit may vary to suit the situation.

While a particular embodiment of the present valve cap for a pneumatic nailer has been shown and described, it will be appreciated by those skilled in the art that changes and modifications may be made thereto without departing from the invention in its broader aspects and as set forth in the following claims.

What is claimed:

1. A pneumatic nailer, comprising:

a tool housing enclosing a cylinder with a reciprocating drive piston, and having a trigger and a workpiece contact element both connected to a trigger valve;

a valve cap mounted to said housing and including a cycle valve and a dump valve, each said valve reciprocating in a respective valve chamber;

said dump valve controlling drive pressure for said drive piston, said cycle valve controlling the return of said dump valve to allow piston return;

said dump valve controlling a main valve controlling pressure to said drive piston and said cycle valve constructed and arranged for receiving signal pressure from a return chamber to move said dump valve to close said main valve; and said valve cap being constructed and arranged such that said piston is returned to a start position independent of positions of said trigger or workpiece contact element.

2. The tool of claim 1, wherein a connection between said cycle valve and said dump valve and said control of said main valve by said dump valve permits piston return while said trigger valve is in an open position.

3. The tool of claim 1, further including a conduit connecting said return chamber to said cycle valve, so that pressure in said return chamber originating from said drive piston descending in said cylinder causes said cycle valve to open and pressurize said dump valve to close said main valve, allowing said return of said piston.

4. The tool of claim 1 wherein said valve cap is mounted to said housing above said cylinder.

5. The tool of claim 4 further including a spacer separating said valve cap from said housing.

6. The tool of claim 5 further including a conduit connecting said return chamber to said cycle valve passing through a space defined by said spacer.

7. A valve cap assembly for installation on a pneumatic nailer having a housing enclosing a cylinder, defining a return chamber and having an upper end opposite a workpiece contact element end, said assembly comprising:

a valve cap enclosing a dump valve and a cycle valve, each said valve having a shuttle being disposed for reciprocation in a respective chamber in said cap;

a conduit connecting said return chamber to said cycle valve for operating a main valve for facilitating piston return to a start position independent of a position of a trigger valve; and a gasket sealing an upper surface of said valve cap, said gasket having an opening disposed such that in a first position, said cycle valve chamber is open, enabling single drive tool operation, and in a second position, said cycle valve chamber is unplugged, enabling automatic tool operation.

8. The assembly of claim 7 further including a top cap constructed and arranged for retaining said gasket upon said valve cap.

9. The assembly of claim 7, further including a spacer configured for disposition between said upper end of said housing and said valve cap, a main valve and a main valve spring.

10. The assembly of claim 9, wherein said main valve and said main valve spring are disposed between said valve cap and said spacer.

11. The assembly of claim 7, further including a modified cylinder having a bulkhead configured for accommodating said conduit.

12. The assembly of claim 7, wherein said valve cap defines a dump valve chamber and a cycle valve chamber disposed in spaced relationship to each other, each said chamber being divided into at least three subchambers.

13. The assembly of claim 12, wherein each said chamber is dimensioned to accommodate a respective shuttle, said shuttles have formations for pneumatically sealing said subchambers from each other in a respective one of said chambers.

14. The assembly of claim 13, further including pathways in said valve cap placing designated subchambers of said dump and cycle valve chamber in fluid communication with each other.

15. The assembly of claim 7, wherein said valve cap includes a signal passageway constructed and arranged for placing said conduit and said cycle valve chamber in fluid communication with each other.

16. The assembly of claim 15 further including an adjustable needle valve in communication with said signal passageway for adjusting flow through said pathway to said valve chamber.

17. A valve cap assembly for installation on a pneumatic nailer having a housing enclosing a cylinder, defining a return chamber and having an upper end opposite a workpiece contact element end, said assembly comprising:

a valve cap enclosing a dump valve and a cycle valve, each said valve having a shuttle being disposed for reciprocation in a respective chamber in said cap;

a conduit connecting said return chamber to said cycle valve for operating a main valve for facilitating piston return to a start position independent of a position of a trigger valve; and a spacer configured for disposition between said upper end of said housing and said valve cap, a main valve and a main valve spring.

18. A valve cap assembly for installation on a pneumatic nailer having a housing enclosing a cylinder, defining a return chamber and having an upper end opposite a workpiece contact element end, said assembly comprising:

a valve cap enclosing a dump valve and a cycle valve, each said valve having a shuttle being disposed for reciprocation in a respective chamber in said cap;

a conduit connecting said return chamber to said cycle valve for operating a main valve for facilitating piston return to a start position independent of a position of a trigger valve; and said valve cap defines a dump valve chamber and a cycle valve chamber disposed in spaced relationship to each other, each said chamber being divided into at least three subchambers.

19. A valve cap assembly for installation on a pneumatic nailer having a housing enclosing a cylinder, defining a return chamber and having an upper end opposite a workpiece contact element end, said assembly comprising:

a valve cap enclosing a dump valve and a cycle valve, each said valve having a shuttle being disposed for reciprocation in a respective chamber in said cap;

a conduit connecting said return chamber to said cycle valve for operating a main valve for facilitating piston return to a start position independent of a position of a trigger valve;

wherein said valve cap includes a signal passageway constructed and arranged for placing said conduit and said cycle valve chamber in fluid communication with each other; and an adjustable needle valve in communication with said signal passageway for adjusting flow through said pathway to said valve chamber.

20. A pneumatic nailer, comprising:

a tool housing enclosing a cylinder with a reciprocating drive piston, and having a trigger and a workpiece contact element both connected to a trigger valve, an upper housing end located opposite said workpiece contact element;

a valve cap mounted to said housing and including a cycle valve and a dump valve, each said valve reciprocating in a respective valve chamber;

said dump valve controlling drive pressure for said drive piston, said cycle valve controlling the return of said dump valve to allow piston return; and a spacer configured for disposition between said upper end of said housing and said valve cap, a main valve and a main valve spring.

* * * * *